US008550455B2

(12) United States Patent
Yamaguchi

(10) Patent No.: US 8,550,455 B2
(45) **Date of Patent: *Oct. 8, 2013**

(54) IMAGE FORMING APPARATUS WITH SHEET DISCHARGE TRAY

(75) Inventor: Noritomo Yamaguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/482,070

(22) Filed: May 29, 2012

(65) Prior Publication Data

US 2012/0235349 A1 Sep. 20, 2012

Related U.S. Application Data

(62) Division of application No. 13/016,030, filed on Jan. 28, 2011, now Pat. No. 8,210,528.

(30) Foreign Application Priority Data

Feb. 12, 2010 (JP) ..... 2010-028536

(51) Int. Cl.
*B65H 31/00* (2006.01)

(52) U.S. Cl.
USPC ..... 271/209; 271/188

(58) Field of Classification Search
USPC ..... 271/188, 209, 220; 399/405
See application file for complete search history.

(56) References Cited

U.S. PATENT DOCUMENTS

| | | | | |
|---|---|---|---|---|
| 7,686,296 | B2 * | 3/2010 | Kaneko et al. | 271/220 |
| 8,099,016 | B2 | 1/2012 | Ito et al. | |
| 8,210,528 | B2 * | 7/2012 | Yamaguchi | 271/209 |
| 2005/0281598 | A1 | 12/2005 | Hattori et al. | |
| 2011/0006472 | A1 | 1/2011 | Hirai et al. | |

* cited by examiner

*Primary Examiner* — Jeremy R Severson
(74) *Attorney, Agent, or Firm* — Fitzpatrick, Cella, Harper & Scinto

(57) ABSTRACT

The present invention provides an image forming apparatus which can secure a stacking ability even when a paper is curled.

An apex portion is provided downstream in the sheet discharge direction with respect to a center of gravity of the sheets discharged on the discharge tray, and an upstream portion in the sheet discharge direction of the sheet is pushed downward by the image reading apparatus, with respect to a downstream end in the sheet discharge direction of the sheet stacked on the discharge tray, at the downstream portion in the sheet discharge direction with respect to the apex portion of the discharge tray, and the upstream portion of the sheet is pressed by a flag while the downstream portion in the sheet discharge direction of the sheet is bent with the apex portion of the discharge tray.

7 Claims, 7 Drawing Sheets

IMAGE FORMING APPARATUS WITH SHEET DISCHARGE TRAY

This is a divisional of U.S. patent application Ser. No. 13/016,030, filed Jan. 28, 2011, and allowed on Mar. 15, 2012.

BACKGROUND OF THE INVENTION

1. Field of the Invention

The present invention relates to an image forming apparatus configured to discharge a sheet on which an image is formed to a space between a main body of the image forming apparatus and an image reading device and, in particular, to a structure to prevent a disorder in a stack of discharged sheets.

2. Description of the Related Art

Conventionally, as an exemplary image forming apparatus, other than facsimile machines or printers, there exists an image forming apparatus in which an image reading device is additionally arranged on a main body of the image forming apparatus in order to add another function such as a copying function. In a case of such an image reading device, since the apparatus grows in size, a space is provided between the image reading device and the main body of the image forming apparatus to discharge sheets thereinto, thereby achieving space saving.

Herein, the image forming apparatus of an internally-sheet-discharging type with such a structure, at a time of image formation, feeds a sheet to an image forming portion to form a toner image on the sheet and thereafter, fixes the toner image on the sheet by means of a fixing portion. Next, the sheet on which the toner image is fixed is discharged and stacked on a sheet discharge tray provided in a space between the image reading device and the image forming apparatus main body.

Herein, the sheet heated up by the fixing portion sometimes becomes greatly curled, i.e., has a curl depending on a condition. If the sheet in such a curled condition is stacked on the sheet discharge tray, the sheet may clog a discharge outlet and in this case, the stacked sheet is pushed out by the next discharged sheet, thereby causing damage to alignment or dropping the sheet from the discharge tray.

It is to be noted that a curl size or direction of the sheet depends on a type of sheet, a basis weight (unit weight), a fiber orientation, an environmental temperature, the amount of toner in a toner image for forming an image on the sheet, a fixing temperature, and the like. As such a curl, there exists a U-shaped curl that both ends parallel to a sheet conveying direction of the sheet are turned up.

A demand for an image forming apparatus of a desktop type which is placed on a desk during use has been increased in recent years. Herein, since such a desktop type image forming apparatus needs to reduce its height, it is necessary to reduce a height in a vertical direction of a discharge space between the discharge tray and the image reading device, in addition to a height of the image forming apparatus main body and a thickness of the image reading device itself. However, as the discharge space is reduced in height, the sheet to be discharged is discharged while being in contact with the bottom surface of the image reading device. Therefore, in order to secure a discharge conveyance ability of sheet, such a conventional structure has been proposed that the discharge tray and the bottom surface of the image reading device are faced to each other (see, U.S. Patent Application Publication No. 2005/281598 A1).

With such a conventional image forming apparatus, when a sheet is curled and a discharge space is low in height, the number of stacked sheets decreases. Especially where a sheet is curled in a U-shape, because of strength of the sheet, sheets S are linearly stacked on the discharge tray 150 one by one along an inclination of the discharge tray 150, as illustrated in FIG. 7.

When the sheets S are linearly stacked one by one on the discharge tray, the front end of the sheet to be discharged eventually abuts the bottom surface of an image reading device 60 positioned above the discharge tray 150. In this case, despite the fact that a discharge space allowing a large number of sheets to be stacked thereon is formed between the image reading device 60 and the discharge tray 150, the subsequent sheet to be discharged after the sheet abuts is jammed between the image reading device 60 and the image discharge tray 150. As a result, the subsequent sheet clogs a discharge outlet 28, thereby decreasing a stacking ability of the shacked sheets, so that the sheet sometimes falls down. As described above, in a case of a curled sheet, the conventional image forming apparatus has an issue that a sheet stacking ability decreases and that the discharge space cannot be effectively utilized.

The present invention has been accomplished in view of such circumstances, and the invention provides an image forming apparatus capable of securing a stacking ability while effectively utilizing a discharge space even when a sheet is curled.

SUMMARY OF THE INVENTION

An image forming apparatus which discharges sheets one by one into a discharge space provided between a main body and an image reading device disposed above the main body, the image forming apparatus comprising, a discharge tray, provided on an upper surface of the main body, which has a convex-shaped stacking surface on which a discharged sheet is stacked, the convex-shaped stacking surface is inclined so as to set an upstream portion in a sheet discharge direction to be lower than an apex portion of the convex-shaped stacking surface, and a sheet pressing member, movable in a vertical direction, configured to press from above an upstream end portion in the sheet discharge direction of the sheet discharged on the discharge tray, wherein the apex portion, extending in a direction intersecting with the sheet discharge direction, is provided downstream in the sheet discharge direction with respect to a center of gravity of the sheet stacked on the discharge tray, and a downstream portion in the sheet discharge direction of the sheet is bent at the apex portion of the convex-shaped stacking surface as a bearing point by abutting with the image reading device while the sheet pressing member is pressing an upstream portion in the sheet discharge direction of the sheet.

According to the present invention, a sheet is bent to reduce its curl by an image reading device and a sheet pressing member with an apex portion of the discharge tray being utilized as a fulcrum, so that even with a curled sheet, a stacking ability can be secured while effectively utilizing a discharge space.

Further features of the present invention will become apparent from the following description of exemplary embodiments with reference to the attached drawings.

DESCRIPTION OF THE EMBODIMENTS

Figure 1:
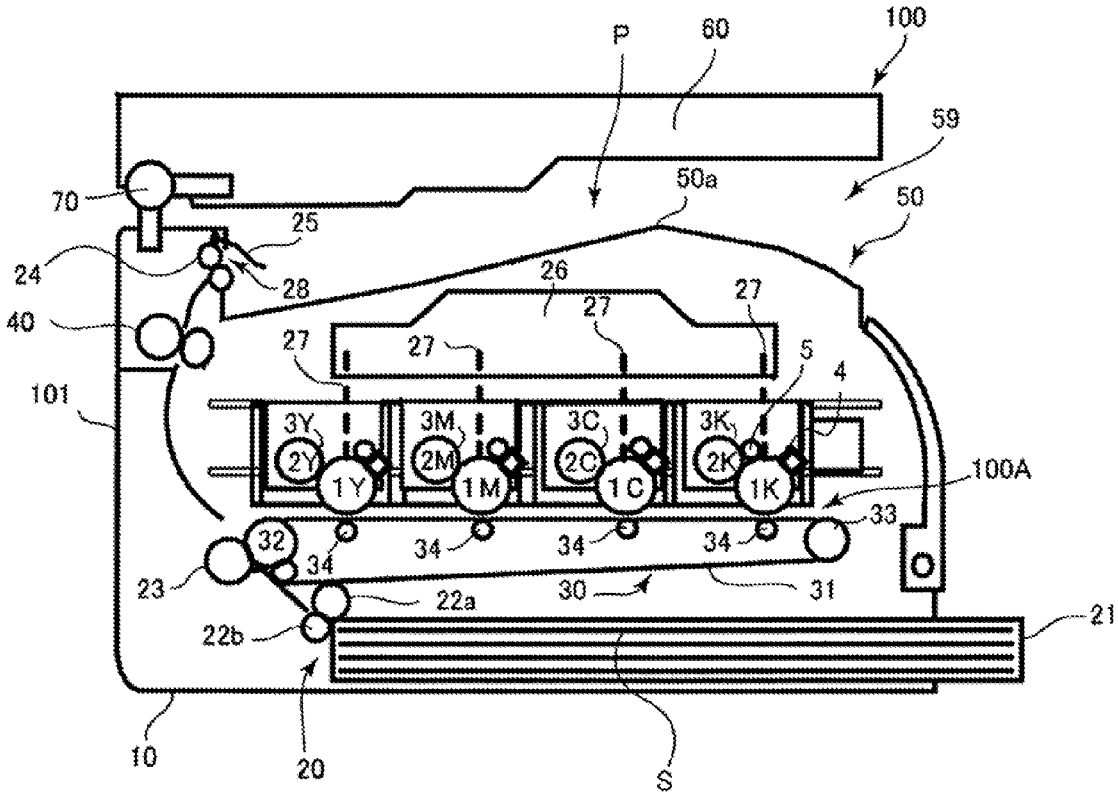
FIG. 1 is a view illustrating an outline configuration of an image forming apparatus according to a first embodiment of the present invention.

In the following, embodiments of the present invention will be described with reference to the drawings. FIG. 1 is a view illustrating an outline configuration of an image forming apparatus according to a first embodiment of the present invention. FIG. 1 illustrates an image forming apparatus 100 and an image forming apparatus main body 101, in which an image reading device 60 configured to read an image on an original is disposed above the image forming apparatus main body (hereinafter referred to as a main body) 101. The image forming apparatus 100 is of an internally-sheet-discharging type that a sheet S on which an image is formed is discharged into a discharge space P formed in the main body 101.

A laser scanner 26 is disposed above the main body 101 and an image forming portion 100A is disposed below the laser scanner 26. The image forming portion 100A is configured to form an image under an electrophotographic system, in which four process cartridges 3 (3Y, 3M, 3C, 3K) for forming toner images in colors of yellow Y, magenta M, cyan C, and black K, respectively, are horizontally disposed.

Herein, the process cartridges 3 are identical in configuration except a toner color, and are provided with photosensitive drums 1 (1Y, 1M, 1C, 1K), respectively. Further, each of the process cartridges 3 is provided with a charging device 5 for charging the photosensitive drum 1, a development device 2 (2Y, 2M, 2C, 2K), and a cleaning device 4, as a processing unit for acting on the photosensitive drum 1. The charging device 5 is a charging roller while the cleaning device 4 is a cleaning blade which removes toner remaining on the photosensitive drum 1 after transfer.

An intermediate transfer belt unit 30 is disposed below the process cartridges 3. The intermediate transfer belt unit 30 includes an intermediate transfer belt 31 made of dielectric material and serving as a flexible endless belt (intermediate transfer member), a driving roller 32 for driving the intermediate transfer belt 31, and a tension roller 33. This intermediate transfer belt 31 abuts each of the photosensitive drums 1 and inside the intermediate transfer belt 31, four primary transfer rollers 34 are disposed so as to face to the photosensitive drum 1 with the intermediate transfer belt 31 intervened therebetween. As described below, the primary transfer rollers 34 transfer toner images formed on the photosensitive drums 1, respectively, in a manner to superimpose these toner images on the intermediate transfer belt 31 so that a full-color toner image is formed on the intermediate transfer belt.

A sheet feeding portion 20 having a feeding roller 22*a* for feeding the sheets S contained in a sheet cassette 21 and a separating roller 22*b* for separating the sheets S while abutting the feeding roller 22*a* are disposed at a lower portion of the main body 101. The sheet feeding portion 20 feeds using the feeding roller 22*a*, the sheet S contained in the sheet cassette 21 to a secondary transfer portion as a nip portion between a secondary transfer roller 23 and the intermediate transfer belt 31 in a manner to be synchronized with formation of the toner image. The fixing device 40 and a pair of discharge rollers 24 are disposed at an upper portion within the main body. Further, the discharge tray 50 is provided at the upper surface of the main body 101, making up the bottom surface of the discharge space P.

Next, an image forming operation of the image forming apparatus 100 thus structured will be described. Upon receipt of image information transmitted by a computer or network such as LAN, not illustrated, connected to the main body 101, or upon receipt of image information read and transmitted by the image reading device 60, the laser scanner 26 emits laser light 27 depending on the image information. With use of this laser beam 27, the surface of the photosensitive drum 1, which the charging device 5 uniformly charges to a predetermined polar character and electric potential, is exposed.

Therefore, electric charge in the exposed portion on the surface of the photosensitive drum is removed, thereby forming an electrostatic latent image. The toner is attached to the electrostatic latent image by the development device 2, so that the image is developed as the toner image. A first cartridge 3Y contains yellow toner inside the development device (developer container) and forms a yellow toner image on the photosensitive drum 1Y. Similarly, a second cartridge 3M contains magenta toner and forms a magenta toner image on the photosensitive drum 1M. A third cartridge 3C contains cyan toner and forms a cyan toner image on the photosensitive drum 1C. A fourth cartridge 3K contains black toner and forms a black toner image on the photosensitive drum 1K.

The first transfer roller 34 then gives a predetermined pressing force and an electrostatic load bias, thereby transferring the toner images formed on the photosensitive drums respectively, onto the intermediate transfer belt 31. It is to be noted that image formation by each of the process cartridges 3 is performed in the timing of superimposition on an upstream toner image which has been primarily transferred onto the intermediate transfer belt. As a result, a full-color toner image is eventually formed on the intermediate transfer belt 31. A little amount of toner remaining on the photosensitive drum 1 after transfer is collected by the cleaning device 4, thereby being prepared for the next formation.

In sync with such image formation, the sheets S are conveyed one by one by means of the feeding roller 22*a* and the separating roller 22*b* from the sheet cassette 21 to a secondary transfer portion as a nip portion between the secondary transfer roller 23 and the intermediate transfer belt 31. The toner image on the intermediate transfer belt 31 is then transferred onto the sheet S upon application of bias on the secondary transfer roller 23. Further, the sheet S onto which the toner image has been transferred is conveyed to the fixing device 40, and then is heated and pressurized by the fixing device 40 to fix the toner image thereon.

Thereafter, the sheet S on which the toner image has been fixed is discharged by the pair of discharge rollers 24 to the discharge tray 50 through the discharge outlet 28. A stacking surface of the discharge tray 50 has a convex shape and is inclined so as to set the upstream portion in the sheet discharge direction to be lower than an apex portion of the convex shape. In this manner, the discharged sheet S is shifted due to self-weight to the upstream in the sheet discharge direction along the convex-shaped stacking surface of the discharge tray 50 to abut an abutment portion 50*c* provided at the upstream end in the sheet discharge direction of the discharge tray 50, thereby being stopped.

The discharge outlet 28 is provided with a flag 25 as a sheet pressing member which is energized in the clockwise direction by a spring, not illustrated, and is pivotally movable. This flag 25 presses the rear end of the sheet as the upstream end in the sheet discharge direction of the sheet after discharged to restrain the sheet rear end from being uplifted, thereby preventing the stacked sheets from clogging the discharge outlet 28. Herein, the front end of the flag 25 is positioned below the discharge outlet 28 before the sheet is discharged, is pivotally moved upward by being pressed by the sheet when the sheet is discharged, and is pivotally moved downward after the sheet is discharged to return to a position in which uplift of the rear end of the topmost sheet of the stacked sheets are restrained.

When the large number of sheets in a curled state are discharged and overlapped with each other onto the discharge tray 50, the flag 25 fails to restrain uplift of the large number of sheets at the same time, thereby not being able to restrain such uplift. Therefore, in this embodiment, a lower position in pivotal movement of the flag 25 before discharge of the sheet is set to a position in which the plural number (2 or 3) of sheets in a curled condition can be restrained from being uplifted in its rear end.

The sheets S thus discharged onto the discharge tray 50 are taken out of a slot 59. In this embodiment, the image reading device 60 is attached in an openable and closable manner to the main body 101 by a hinge 70. When the discharged sheet is a small-sized sheet such as a postcard which is hardly viewed through the slot 59, the image reading device 60 is pivotally moved upward to take out the sheet.

The discharge tray 50 has a convex portion 50*a* extending a width direction intersecting with the sheet discharge direction, and this convex portion 50*a* supports the sheets discharged and stacked onto the discharge tray 50. This convex portion 50*a* is formed in a downstream position in the sheet discharge direction with respect to a gravity center position of the sheet S at the timing of abutting the abutment portion 50*c* after being discharged.

Formation of the convex portion 50*a* in such a position makes it easy for the flag 25 to prevent uplift of the sheet rear end. Further, formation of the convex portion 50*a* extending in a width direction in such a position makes it possible to bend the sheet while turning downward the front end as the downstream end in the sheet discharge direction of the discharged sheet, with the apex portion 50*a* being utilized as a fulcrum. In this manner, even the sheet curled in a U-shape can be bent with the front end of sheet being turned down.

Figure 2A:
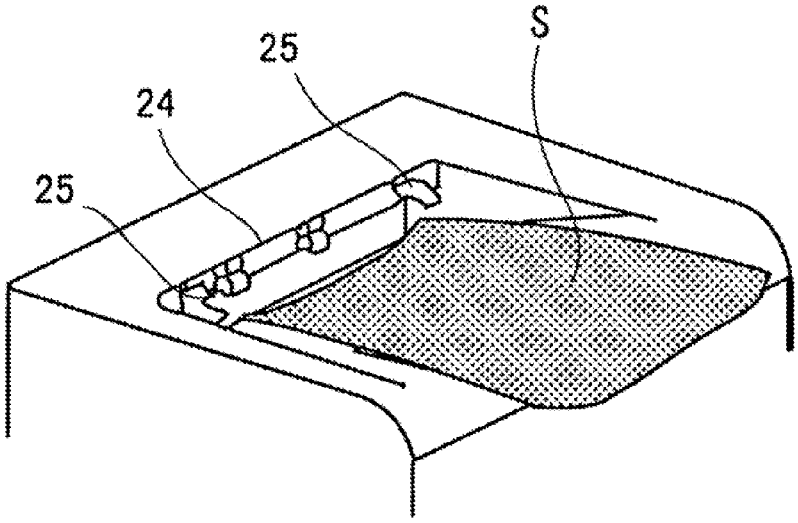
FIGS. 2A and 2B are views illustrating a stacking condition of sheets curled in a U-shape within the image forming apparatus.
Figure 2B:
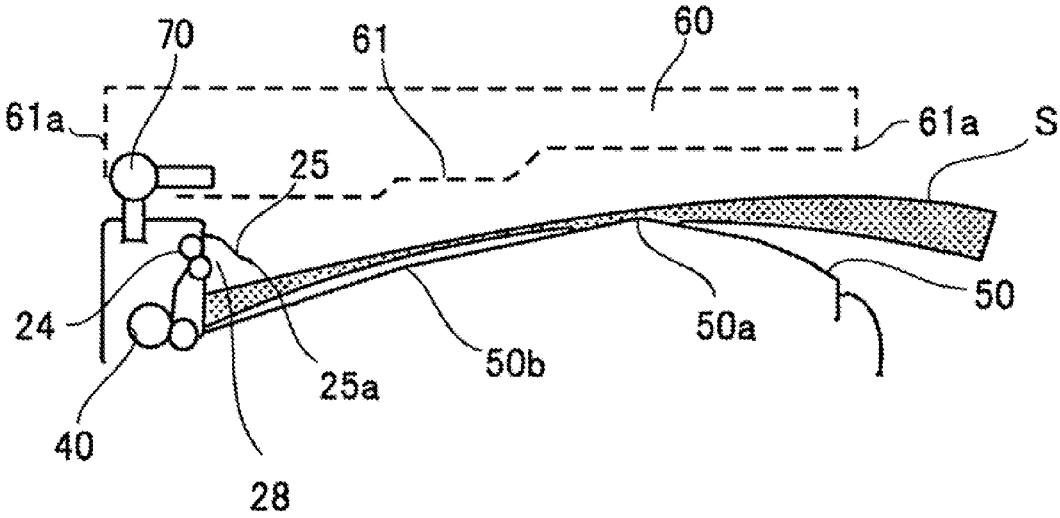

FIGS. 2A and 2B are views illustrating a stacking condition of the sheet in which a curl is not large. FIG. 2A is a perspective view illustrating a condition in which the sheet front end is turned down while the convex portion 50*a* of the discharge tray 50 is utilized as a fulcrum, and FIG. 2B is its side view. As illustrated in FIGS. 2A and 2B, when the sheet S in which a curl is not large is discharged onto the discharge tray 50, the rear end is pressed by the flag 25. Thus, the sheet S is bent due to self weight with the convex portion 50*a* being set as a boundary, and when the sheet S is bent in this manner, a curl is restrained at least at the vicinity of the convex portion.

The effect produced by bending the sheet due to self weight becomes the greatest when a position corresponds to one half-length of the sheet, in which the moment of bending the sheet is the greatest. Thus, in the present invention, the convex portion 50*a* which supports the sheet is set to a position with a distance L1 from the abutment portion 50*c*, which is downstream with respect to a position corresponding to one half-length of the sheet, in consideration of reduction in uplift of the rear end and in the curl owing to a folding back effect.

Herein, in a case of a small curl, the sheets are stacked while being bent downward due to self weight. In a case of a large curl, on the other hand, the sheets are bent while being hardly bent downward. Thus, in this embodiment, the discharge tray 50 and the image reading device 60 are configured to certainly stack the sheets one by one and reduce their curl while bending them downward, in a case of a large curl.

That is, in this embodiment, as illustrated in FIGS. 2A and 2B, the image reading device 60 has a length in the sheet discharge direction such that a front end 61*a* (hereinafter, referred to as a bottom surface front end), as a downstream end of bottom surface 61 in the sheet discharge direction, is positioned upstream in the sheet discharge direction with respect to the sheet front end position. It is to be noted that in this embodiment, a length in the sheet discharge direction of the image reading device 60 is set shorter than that of a sheet of the maximum on which an image is to be formed. In this manner, the bottom surface front end 61*a* is positioned upstream in the sheet discharge direction with respect to the sheet front end position.

Figure 3:
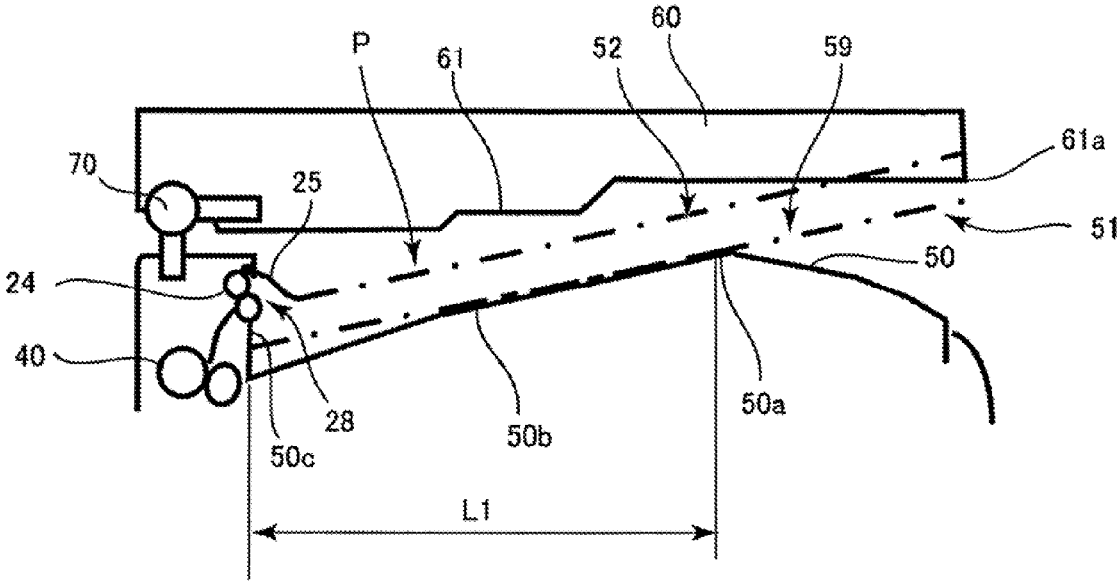
FIG. 3 is a view illustrating a configuration of a discharge space P of the image forming apparatus.

Herein, in FIG. 3, a first straight line 51 is defined as a straight line (tangent line) that passes through the convex portion 50*a* of the discharge tray 50 and connects to the position 50*b* which is upstream in the sheet discharge direction with respect to the convex portion 50*a* of the discharge tray 50 and comes in contact with the sheet S. A second straight line 52 is defined as a straight line which is parallel to the first straight line 51 and passes through a height position of the front end of the flag 25 in a state of being positioned at the lowest. This second straight line 52 and the bottom surface 61 of the image reading device 60 intersect on a point which is downstream in the sheet discharge direction with respect to the convex portion 50*a* as well as upstream in the sheet discharge direction with respect to the bottom surface front end 61*a*.

Described next is movement of the sheet at the time of stacking in the image forming apparatus 100 structured as described above.

Upon discharge of the first sheet curled in a U-shape, the sheet is discharged along the discharge tray 50 illustrated in FIG. 3 and eventually the front end abuts the bottom surface 61 (hereinafter, referred to as the bottom surface) of the image reading device 60. Herein, when a curl amount of the sheet is not large, that is, a strength of the sheet is not so great, when the front end abuts the bottom surface 61 as described above, a curl of the sheet is reduced and accordingly, a strength of the sheet decreases, so that the sheet is bent with the front end of sheet being turned down by abutting with the bottom surface 61. Thereafter, when the sheet rear end passes through the pair of discharge rollers 24, the sheet rear end is pressed down by the front end of the flag 25 while the sheet is stacked on the discharge tray, and the center in the sheet discharge direction of the sheet is supported by the convex portion 50*a* of the discharge tray 50.

Figure 4A:
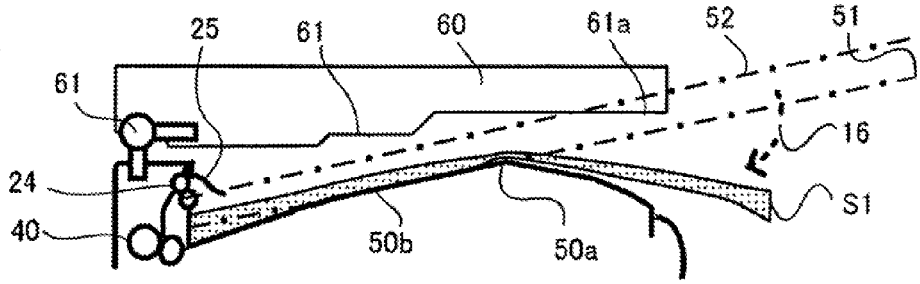
FIGS. 4A to 4E are views illustrating movement of sheets at a time of discharging sheets from the image forming apparatus.
Figure 4B:
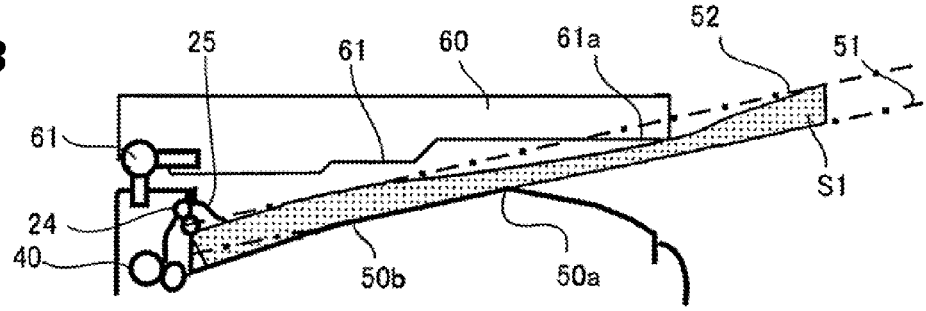

As described above, upon discharge, the sheet receives application of a force in a direction of an arrow 16 as a direction in which the sheet is along the discharge tray 50, on three points, i.e., the bottom surface 61, the convex portion 50*a* of the discharge tray 50, and the flag 25. When a force is applied on the three points as described above, in a case of a small curl of the sheet, the first sheet S1 is stacked while being bent with the front end part being turned down on the condition that the convex portion 50*a* is set as a boundary, as illustrated in FIG. 4A.

Herein, when the front end part is turned down, a curl around the convex portion 50*a* is cleared up. Further, if the curl is cleared up around the convex portion 50*a*, because of its effect, a curl amount is also reduced at the sheet front end. Along with clearing up the curl around the convex portion 50*a*, a curl amount in the front end and the rear end of the sheet is also reduced, so that the stacking ability is secured while increasing the stacking amount, thereby being able to utilize the discharge space effectively.

On the other hand, in a case of a large curl of the sheet, upon discharge of the sheet S1, the sheet S1 is discharged along the discharge tray 50 and eventually the front end abuts the bottom surface 61, so that the sheet S1 is pushed downward. Herein, the sheet S1 with a large curl is not bent downward because of its great strength even if being pushed by the bottom surface 61 as described above. However, when the sheet is further discharged thereafter, the front end of the sheet S1 passes through the bottom surface front end 61*a*, so that the upstream part in the sheet discharge direction with respect to the sheet front end abuts the bottom surface front end 61*a*. In this manner, the upstream part in the sheet discharge direction is pushed downward and the downward part in the sheet discharge direction of the sheet S1 is bent.

Thereafter, when the back rear end passes through the pair of discharge rollers 24, the sheet rear end is pressed down by the front end of the flag 25 while the sheet S1 is stacked on the discharge tray and the center in the sheet discharge direction of the sheet S1 is supported by the convex portion 50*a* of the discharge tray 50. Accordingly, the sheet S1 is bent with the front end as the downstream part in the sheet discharge direction being turned down is stacked on the discharge tray 50 while being placed along the first straight line 51 and reducing a curl in the abutment part between the vicinity of the convex portion 50*a* and the bottom front end 61*a*.

Figure 4C:
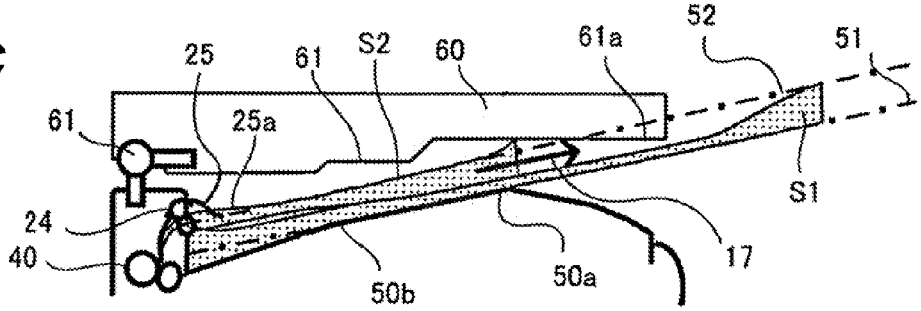

After the first sheet S1 is stacked on the discharge tray 50 in a condition described above, the second sheet S2 as a subsequent sheet is discharged along the sheet S1 through the discharge outlet 28 onto the discharge tray 50. When the second sheet S2 is discharged, the upper ends of the both sides in the width direction of the front end of the second sheet S2 abuts the bottom surface 61 in the middle of discharge, thereby being pushed downward as indicated in FIG. 4C. The sheet S2 has a great strength and thus is not bent downward but reduces a curl amount at the time of abutting the bottom surface 61 as described above. Further, because of the second sheet S2, the first sheet S1 in contact with the second sheet S2 receives application of a force for pressing down the first sheet S1. This force is exerted on the part of the first sheet S1, supported by the convex portion 50*a*, so that the curl of the first sheet S1 in the vicinity of the convex portion 50*a* is further reduced.

Figure 4D:
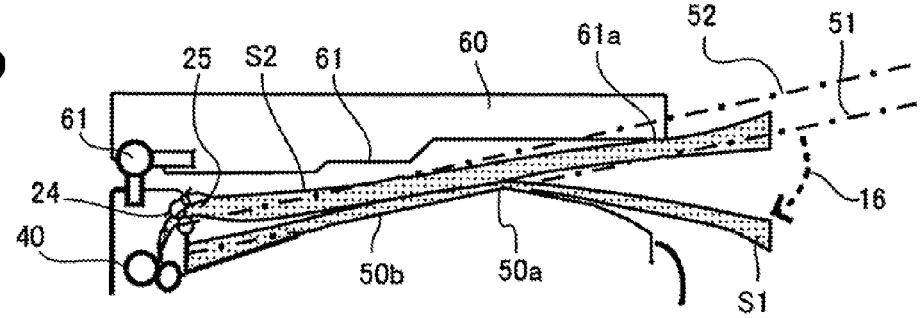

Thereafter, when the front end of the second sheet S2 abuts the bottom surface front end 61*a*, the front end is pressed down while a force applied by the second sheet S2 to press down the first sheet S1, shown by an arrow 16 in FIG. 4D is increased. Further, the front end of the first sheet S1 is distant from the bottom surface 61, thereby being bent more easily, compared with a case where the sheet is in abutment with the bottom surface 61. As a result, a curl of the first sheet S1 in the vicinity of the convex portion 50*a* is further reduced, thereby decreasing a strength of the first sheet S1, so that the first sheet S1 is bent with the front part being turned down while the convex portion 50*a* is set as a boundary.

Thereafter, when the sheets are discharged one by one, as described above, curls of the sheets which have been discharged so far, at the vicinity of the convex portion 50*a*, are reduced, so that a reduced amount of curl is increased as much as that of the underlying sheet. When the sheets are discharged one by one, a bearing point 50*a*' positioned above the convex portion 50*a*, that is, the bearing point 50*c* set by the stacked sheets is shifted upward, thereby being set in a condition illustrated in FIG. 4E.

Figure 4E:
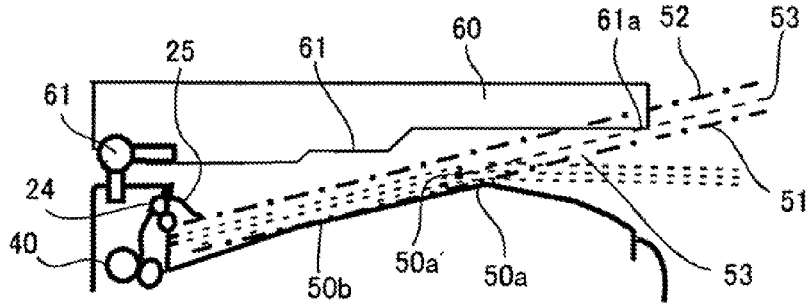

Herein, in FIG. 4E, a straight line which is parallel to the first straight line 51 and passes through the bottom surface front end 61*a* is defined as a third straight line 53. After the bearing point 50*a*' shifted upward is shifted up to the third straight line 53, although there has been a case so far that the sheet is discharged without bringing the front end in abutment with the bottom surface 61, the sheet which is subsequently discharged always abuts the bottom surface 61 with the front end. When the sheet front end abuts the bottom surface 61, the sheet is then shifted along the bottom surface 61 while clearing up a curl and eventually, the sheet is stacked while being bent with the front end being turned down while the bearing point 50*a*' is set as a boundary.

As described above, in this embodiment, a curl of sheet is reduced by bending the sheet downward by means of the image reading device 60 and the flag 25, utilizing the apex portion 50*a* of the discharge tray 50 as the bearing point. In this manner, even when a sheet is curled, the stacking ability can be secured while utilizing the discharge space P effectively. As a result, an installation height of the image reading device 60 can be set low, thereby enabling the image forming apparatus main body 101 to be reduced in size without reducing the number of stackable sheets.

Figure 5:
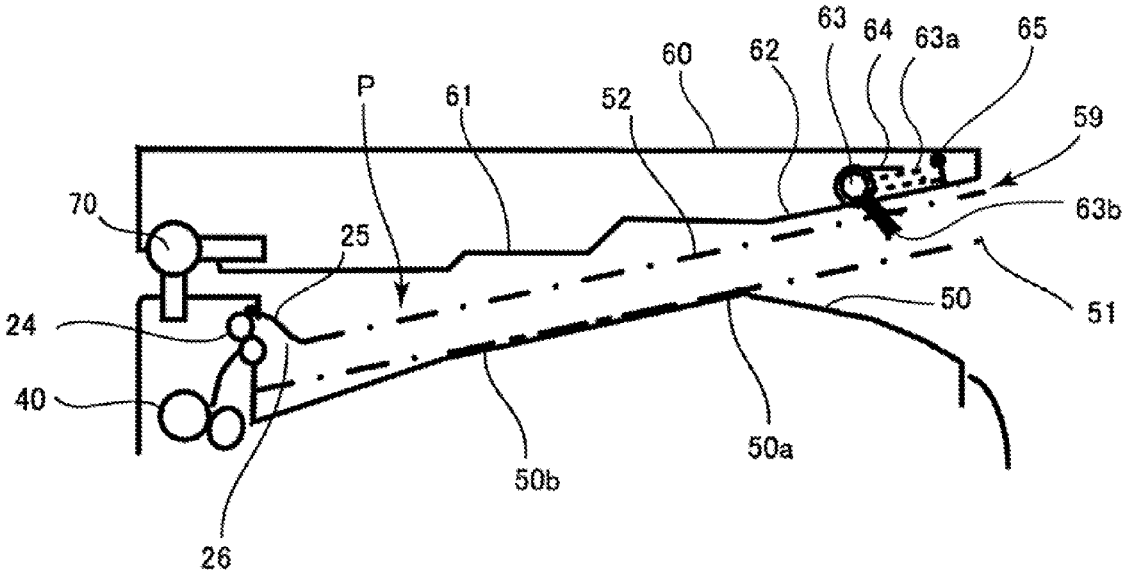
FIG. 5 is a view illustrating a configuration of a discharge space of an image forming apparatus according to a second embodiment of the present invention.

Next, a second embodiment of the invention will be described. FIG. 5 is a view illustrating a configuration of a discharge space of an image forming apparatus according to this embodiment of the present invention. In FIG. 5, the same symbols as those in FIG. 3 represent the same or corresponding portions.

FIG. 5 illustrates an inclined surface 62 which is formed at the front end of the bottom surface 61 as the downstream end in the sheet discharge direction and is positioned closer to the image reading device than the second straight line 52. The inclined surface 62 making up a bottom surface inclined as described above is provided so that, when the sheet discharged on to the discharge space P is not curled, the sheet is discharged and stacked on the discharge tray without abutting the bottom surface 61.

Further, a turning member 63 as a projecting member is attached to the inclined surface 62 in a pivotally movable manner, and has a width enough to press the entire width of the sheet or the ends in the width direction of the sheet. Further, the turning member 63 is energized in the clockwise direction to the image reading device 60 by a torsion coil spring 64 having one end secured to the image reading device 60.

When the turning member 63 is used on the condition that the sheet is not curled, this turning member 63 is held by a locking member 65, in a position contained inside the image reading device shown by a broken line, in which the locking member 65 is attached to the image reading device in a pivotally movable manner. As described above, when the sheet is not curled, the turning member 63 is contained inside the image reading device so that a space in a vertical direction of the slot 59 can be widened to improve the visibility of the sheet.

When the turning member 63 is used on the condition that the sheet is curled, the locking member 65 is turned and unlocked so that the front end of the turning member 63 can be projected in a position shown by a numeral 63*b* closer to the discharge tray than the second straight line 52. The front end of the turning member 63 is moved to a position 63*a* closer to the discharge tray than the second straight line 52 so that the downstream part in the sheet discharge direction of the sheet can be pushed downward in a similar manner of the first embodiment. Thus, the sheets can be discharged and stacked on the discharge tray while reducing a curl.

In this embodiment, as described above, the turning member 63 is attached to the front end of the bottom surface 61, so that when the sheet is not curled, the visibility of the sheet can be improved by containing the turning member 63 in the image reading device. Further, when the turning member is used on the condition that the sheet is curled, the turning member 63 is projected so that the sheets can be discharged and stacked on the discharge tray while reducing a curl.

Figure 6:
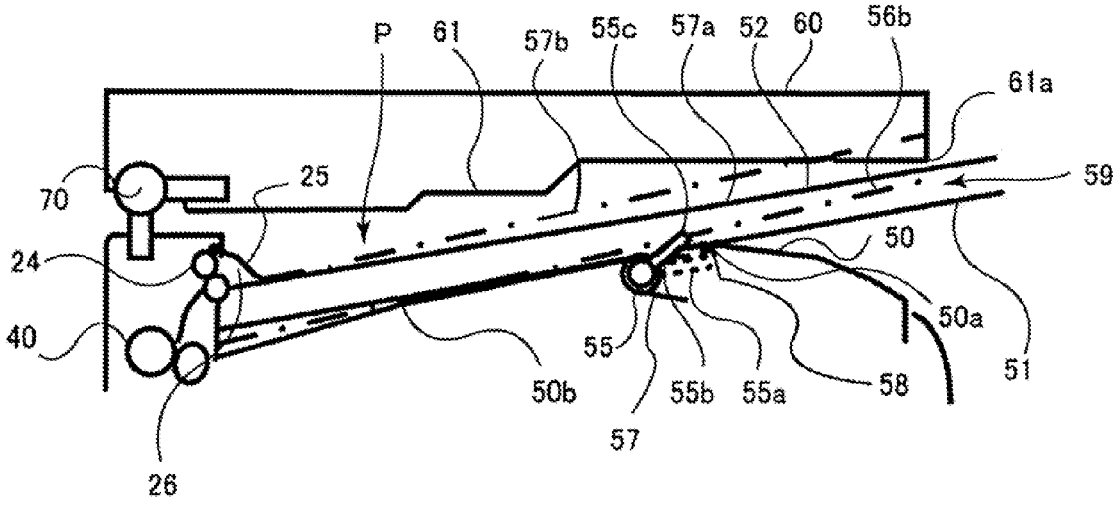
FIG. 6 is a view illustrating a configuration of a discharge space of an image forming apparatus according to a third embodiment of the present invention.
Figure 7:
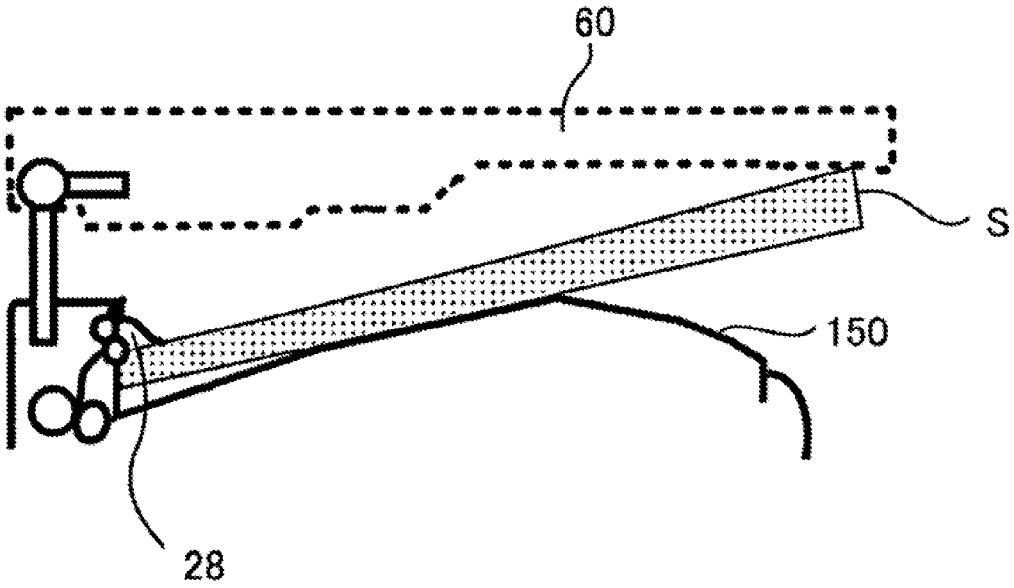
FIG. 7 PRIOR ART
FIG. 7 is a view illustrating a stacking condition of curled sheets within a conventional image forming apparatus.

Next, a third embodiment of the invention will be described. FIG. 6 is a view illustrating a configuration of a discharge space of an image forming apparatus according to the third embodiment of the present invention. In FIG. 6, the same symbols as those in FIG. 3 represent the same or corresponding portions.

FIG. 6 illustrates the turning member 55 as a projecting member attached to the vicinity of the apex portion 50*a* of the discharge tray 50 has a width enough to support the entire width of the sheet or the center in a width direction of the sheet. Further, this turning member 55 is energized by a torsion coil spring 57 having one end secured to the discharge tray, in a manner that the turning member 55 can be projected from the vicinity of the apex portion 50*a*.

When the turning member 55 is used on the condition that the sheet is not curled, this turning member 55 is held by a locking member 58, in a position 55*a* contained inside the discharge tray shown by a broken line, in which the locking member 58 is attached to the discharge tray 50 in a pivotally movable manner. As described above, when the sheet is not curled, the turning member 55 is contained inside the discharge tray so that a space in a vertical direction of the slot 59 can be widened to improve the visibility of the sheet.

When the turning member 55 is used on the condition that the sheet is curled, the locking member 58 is turned and unlocked so that the front end 55*c* of the turning member 55 can be projected in a position 55*b* closer to the image reading device than the second straight line 52, in which the sheet is supported as illustrated in FIG. 6. Herein, a fourth straight line 56*b* is defined as a straight line passing through the projected front end 55*c* of the turning member 55 and coming in contact in an upstream position 50*b* of the discharge tray 50. A fifth straight line 57*b* is defined as a straight line which is in parallel to the fourth straight line 56*b* and passes through the downmost position of the flag 25.

The fifth straight line 57*b* and the bottom surface 61 intersect in a position closer to the downstream in the sheet discharge direction than the apex portion 50*a* as well as closer to the upstream in the sheet discharge direction than the bottom surface front end 61*a*. As described above, likewise the first embodiment described above, the sheets can be discharged and stacked on the discharge tray while reducing a curl.

In this embodiment, as described above, the turning member 55 is attached to the discharge tray 50, so that when the sheet is not curled, the visibility of the sheet can be improved by containing the turning member 55 in the discharge tray. Further, when the turning member 55 being used on the condition that the sheet is curled, the turning member 55 is projected upward more than the apex portion 50*a* to make up the apex portion for supporting the sheets, so that the sheets can be discharged and stacked on the discharge tray while reducing a curl.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-028536, filed Feb. 12, 2010, which is hereby incorporated by reference herein in its entirety.

What is claimed is:

1. An image forming apparatus having a discharge space provided between a main body and an image reading device disposed above the main body, the image forming apparatus comprising:

a discharge portion configured to discharge a sheet into the discharge space;

a sheet pressing member, provided downstream of the discharge portion in the sheet discharge direction, movable in a vertical direction, and configured to press the sheet from above; and a discharge tray, provided at a bottom of the discharge space, on which a discharged sheet is stacked, and which has a convex-shaped stacking surface, the convex-shaped stacking surface provided with an apex portion as a fulcrum at which the sheet is bent downward by abutting with a bottom surface of the image reading device at a downstream position in the sheet discharge direction from the apex portion while the sheet pressing member is pressing the sheet at an upstream position in the sheet discharge direction from the apex portion so as to restrain a curl of the sheet that both ends of the sheet parallel to the sheet discharge direction are turned up.

2. The image forming apparatus according to claim 1, wherein the convex-shaped stacking surface is inclined so as to set an upstream portion in a sheet discharge direction from the apex portion to be lower than the apex portion.

3. The image forming apparatus according to claim 1, wherein the sheet stacked on the discharge tray is bent by pressing of a downstream portion of a subsequent sheet bent downward by abutting with the image reading device.

4. The image forming apparatus according to claim 1, wherein the apex portion is provided downstream in the sheet discharge direction with respect to a center of gravity of the sheet stacked on the discharge tray.

5. The image forming apparatus according to claim 1, wherein the apex portion extends in a direction intersecting with the sheet discharge direction.

6. The image forming apparatus according to claim 1, wherein the discharge portion has a plurality of discharge roller pairs arranged in a direction intersecting with the sheet discharge direction to maintain a distance with each other.

7. The image forming apparatus according to claim 1, wherein a length in the sheet discharge direction of the image reading apparatus is made shorter than a length in the sheet discharge direction of a sheet having a maximum size on which an image is formed.

* * * * *